US009121670B2

(12) United States Patent
Fox et al.

(10) Patent No.: US 9,121,670 B2
(45) Date of Patent: Sep. 1, 2015

(54) OPERATIONAL CONTROL LOGIC FOR HARMONIZED TURRET WITH GIMBALED SUB-SYSTEMS

(71) Applicant: DRS Sustainment Systems, Inc., St. Louis, MO (US)

(72) Inventors: Michael T. Fox, St. Charles, MO (US); Bruce E. Exely, St. Louis, MO (US); Michael C. Mareschal, O'Fallon, MO (US); Thomas D. Linton, Lake Saint Louis, MO (US)

(73) Assignee: DRS Sustainment Systems, Inc., St. Louis, MO (US)

( * ) Notice: Subject to any disclaimer, the term of this patent is extended or adjusted under 35 U.S.C. 154(b) by 0 days.

(21) Appl. No.: 14/454,634

(22) Filed: Aug. 7, 2014

(65) Prior Publication Data

US 2015/0153128 A1 Jun. 4, 2015

Related U.S. Application Data

(63) Continuation of application No. 13/691,457, filed on Nov. 30, 2012, now Pat. No. 8,833,232.

(60) Provisional application No. 61/565,961, filed on Dec. 1, 2011, provisional application No. 61/555,176, filed on Nov. 30, 2011.

(51) Int. Cl.
*F41G 3/10* (2006.01)
*F41G 5/24* (2006.01)

(52) U.S. Cl.
CPC ... *F41G 5/24* (2013.01); *F41G 3/10* (2013.01)

(58) Field of Classification Search
None
See application file for complete search history.

(56) References Cited

U.S. PATENT DOCUMENTS

| | | | | |
|---|---|---|---|---|
| 2,440,968 | A | | 5/1948 | Colbath et al. |
| 2,454,806 | A | | 11/1948 | Kemmer et al. |
| 2,628,535 | A | | 2/1953 | Jackson, Jr. et al. |
| 2,633,060 | A | * | 3/1953 | Topham et al. ..... 89/41.18 |
| 2,660,793 | A | | 12/1953 | Holschuh et al. |
| 3,602,088 | A | | 8/1971 | Spring |
| 4,194,432 | A | | 3/1980 | Conway et al. |
| 4,583,444 | A | | 4/1986 | Jackson |
| 4,760,770 | A | | 8/1988 | Bagnall-Wild et al. |
| 5,197,691 | A | | 3/1993 | Amon et al. |
| 5,353,680 | A | | 10/1994 | Tiomkin et al. |
| 5,720,090 | A | | 2/1998 | Dawson, Jr. |
| 5,974,643 | A | | 11/1999 | Hays et al. |
| 6,396,235 | B1 | | 5/2002 | Ellington et al. |
| 6,442,815 | B1 | | 9/2002 | Moon et al. |
| 7,624,670 | B2 | | 12/2009 | Richeux |

(Continued)

FOREIGN PATENT DOCUMENTS

| | | | |
|---|---|---|---|
| DE | 33 07 069 | * | 6/1984 |
| DE | 32 29 819 | * | 2/1985 |

(Continued)

*Primary Examiner* — Stephen M Johnson
(74) *Attorney, Agent, or Firm* — Kilpatrick Townsend & Stockton LLP

(57) ABSTRACT

Methods, computer-readable media, and systems are disclosed for controlling a turret assembly with two or more gimbaled, swivel assembly sub-systems, such as a gimbaled gun and a gimbaled electro-optical sensor. The turret can be automatically slewed in response to one of the swivel assemblies rotating. A user can switch turret modes reflecting a priority between the gimbaled sub-systems system so that one takes priority over the other(s) during a mission.

15 Claims, 10 Drawing Sheets

(56) References Cited

U.S. PATENT DOCUMENTS

| | | | | |
|---|---|---|---|---|
| 8,245,624 | B1 | 8/2012 | Green | |
| 2006/0283316 | A1 | 12/2006 | Richeux | |
| 2007/0119296 | A1 | 5/2007 | Niv et al. | |
| 2009/0164045 | A1 * | 6/2009 | Deguire et al. | 700/259 |
| 2012/0191292 | A1 | 7/2012 | McKee et al. | |

FOREIGN PATENT DOCUMENTS

| | | | |
|---|---|---|---|
| DE | 3229819 | C2 | 2/1985 |
| GB | 496760 | A | 6/1937 |
| GB | 596253 | A | 7/1945 |

* cited by examiner

MODES

OPERATIONAL CONTROL LOGIC FOR HARMONIZED TURRET WITH GIMBALED SUB-SYSTEMS

CROSS-REFERENCES TO RELATED APPLICATIONS

This application is a continuation of U.S. application Ser. No. 13/691,457, filed Nov. 30, 2012, now U.S. Pat. No. 8,833,232, which claims the benefit of U.S. Provisional Application No. 61/565,961, filed Dec. 1, 2011, and U.S. Provisional Application No. 61/565,176, filed Nov. 30, 2011, the entire contents of which are incorporated herein in their entireties for all purposes.

STATEMENT AS TO RIGHTS TO INVENTIONS MADE UNDER FEDERALLY SPONSORED RESEARCH AND DEVELOPMENT

NOT APPLICABLE

BACKGROUND

1. Field of the Invention

In general, embodiments of the present invention relate to controlling machine support systems and, in particular, control methods for aligning and harmonizing gimbaled sensor and/or weapon systems on a rotating turret of a military vehicle.

2. Description of the Related Art

On military vehicles, whether ground-, sea-, aircraft-, or space-based, the placement and orientation of a sensor can be important. A warfighter's situational awareness, including that used for driving/piloting, collision avoidance, navigation, covert observation, targeting, etc. may depend upon having the best, least obstructed view. A line-of-sight sensor, which includes a sensor that requires an unobstructed line in space to what it is sensing, should not be occluded by the vehicle itself, human operators, large communication antennas, or other protrusions.

A "line-of-sight sensor" can include a millimeter wave scanner, ultraviolet sensor, optical sensor, infrared sensor, radar, lidar, laser rangefinder, or other sensor as is known in the art.

Mounting a sensor on a vehicle so that it can be rotated or swiveled 360° horizontally allows the sensor to be slewed in azimuth to look at almost any off-board location independent of the heading of the vehicle. Thus, an operator of a sensor does not need to tell the driver or pilot of the vehicle to turn the vehicle so that he or she can see a target. However, especially on surface vehicles, because of the need to mount antennas, weapons, and other sensors, a 360° rotatable sensor almost invariably is occluded by at least one protrusion from the vehicles unless the sensor is mounted higher than all other protrusions from the vehicles.

Mounting the sensor on a mast is one way of elevating the sensor above all other protrusions on a ground vehicle. However, the higher the mast, the greater the "signature," or observability of the vehicle to an enemy. Furthermore, a mast expands the size envelope of the vehicle—making it less transportable on ships and cargo aircraft. Weight is also increased when the mass of the mast is taken into consideration.

Much of the same that can be said about sensors can also be said for line-of-sight weapons. A line-of-sight weapon, which includes weapons that require a relatively unobstructed line in space to what they are shooting, should not be occluded by the vehicle itself, human operators, communication antennas, or other protrusions such as sensors.

A "line-of-sight weapon" can include a gun, directional missile or rocket launcher, grenade launcher, microwave weapon, ultrasonic weapon, electromagnetic impulse weapon, weaponized laser, or other weapon as is known in the art.

A weaponized laser includes a laser with sufficient power to burn or singe a target at a tactical distance (e.g., >100 kW) or lower-powered lasers that can permanently or temporarily blind humans, charge coupled device (CCD) sensors of missiles, or electronic apertures.

Mounting a weapon on a ground vehicle so that it can be rotated or swiveled 360° horizontally allows the weapon to shoot at almost any off-board location independent of the heading of the vehicle. Mounting the weapon higher than any other protrusion can ensure that it is not blocked. Yet, the same problems that arise with line-of-sight sensors arise with line-of-sight weapons.

Indeed, aimable, directable, guidable, steerable, swivelable, or otherwise pointable devices, such as line-of-sight sensors or weapons, share the same problem in that they all should have an unobstructed 360° around them, yet they cannot all be the highest-mounted device.

Positioning and orienting both a pointable sensor and weapon on a vehicle typically involves design trade offs. If the flexibility of 360° situational awareness with the sensor is deemed more important than the flexibility of 360° prosecution of a target, then the sensor is typically mounted higher on a ground vehicle than the weapon. The weapon is not allowed to rotate to fire at the sensor lest it shoot up the sensor. If the flexibility of 360° prosecution of a target is deemed more important than the flexibility of 360° situation awareness with the sensor, then the weapon is mounted higher. The sensor cannot look through the weapon, and the vehicle driver must be cognizant to position the vehicle so that a target can be viewed by the sensor.

To alleviate this problem, more sensors or weapons can be used. For example, multiple sensors can be mounted fore and aft of a central pylon for a weapon. The fore and aft sensors fill in the view where the other sensor(s) would be occluded by the pylon or weapon.

As sensors become less expensive, the alternative option of having multiple sensors is becoming more viable. Even so, having multiple sensors is usually more costly, complicated, and heavier than having just one sensor. This can be especially true in situations where the 360° slewing of the sensor is not just provided by a single rotational point but by a gimbal that allows movement both in azimuth and elevation.

U.S. Pat. No. 8,245,624 to Green discloses two weapons mounted to the same rotatable turret. Like a World War II vintage battleship turret housing multiple guns, a .50 caliber M2HB and a 40 mm MK 19 automatic grenade launcher that are aimed by a common turret at the same offboard target are disclosed in the '624 patent. This allows the two weapons to rotate to shoot a target without interfering with each other's line of bore. Yet, this solution does not solve the problem of having a sensor mast mounted nearby that could obstruct the weapons.

There is a need in the art for more flexible weapon and sensor mounting systems.

BRIEF SUMMARY

Generally, novel methods are disclosed for aligning and harmonizing two or more independently pointable devices, such as a swivelable gimbaled sensor and a gimbaled weapon, that are mounted on the same rotating turret. In development, this has been informally called a "lazy Susan design." The novel turret/gimbal structure can be controlled with the methods described herein. The methods include automatically rotating the turret as a result of one of the pointable devices rotating beyond a specific angle with respect to the other device in order to keep the field of view clear or protect the other device. Optionally, they can include automatically rotating the other pointable device in response to the turret being rotated, typically in an equal and opposite angle to compensate for the rotation of the turret by self stabilization or otherwise.

In operation of one embodiment, if a weapon is in the way of a sensor's line of sight to an off-board target, then the turret can be rotated so that the sensor moves out from behind the weapon (and the weapon moves out from front of the sensor). Conversely, if a situation occurs in which the sensor is in the way of the weapon's line of bore/fire to the target, then the turret is rotated so that the weapon moves out from behind the sensor (and the sensor moves out from front of the weapon). Alternatively, the turret can also closely follow the weapon's azimuth in order to keep the weapon 'in front.'

The methods include slaving one line-of-sight device to another line-of-sight device and then switching the order based on a user-selectable mode switch. They include moving a slaved sensor to the protected rear while a gun is firing, and they can include offsetting the sensor from directly in back of the gun in order to avoid damage from ejected shells, muzzle blast, or smoke blowing across its field of view. It can also include switching modes so that one of the pointable devices has pointing priority over the other device, and it can include entering a master-slave or "slew to cue" relationship in which one device is slaved to point where the other device points.

A vehicle can be driven and turned 'underneath' (or piloted and turned 'overhead') the turret while the turret keeps the independently pointable sensors and weapons from conflicting with one another. The turret can keep a sensor and weapon at 90° perpendicular to each other and an off-board target so that each sub-system has a full view of the target. For target engagement, an operator can flip a switch and prioritize the weapon so that the turret slews to be nearest the target, it in front of the sensor, and the sensor rotates away, protecting its aperture.

Some embodiments of the present application are related to a method for controlling a turret with swivel assemblies mounted thereon. The method includes providing a turret having a rotatable platform, the rotatable platform at a first position supporting a first swivel assembly for a first pointable device, the rotatable platform at a second position supporting a second swivel assembly for a second pointable device, detecting a rotation angle of the first swivel assembly, slewing the rotatable platform based on the detected rotation angle of the first swivel assembly, and turning the second swivel assembly based on the slewing.

The method can include receiving from an operator a user-configurable mode change, detecting a rotation angle of the second swivel assembly, revolving the rotatable platform based on the detected rotation angle of the second swivel assembly and the mode change, and turning the first swivel assembly based on the revolving of the rotatable platform.

Some embodiments relate to a method for controlling a turret with swivel assemblies mounted thereon. The method includes rotating a first swivel assembly for a first pointable device, the first swivel assembly supported by a first portion of a rotatable platform on a turret, the turret having a second swivel assembly for a second pointable device supported by a second portion of the rotatable platform, the second pointable device pointing at an off-board location, slewing the turret based on the rotation of the first swivel assembly, and rotating the second swivel assembly opposite the rotation of the slewing of the turret such that the second pointable device continues to point at the off-board location.

Some embodiments relate to a method for targeting two independently gimbal-stabilized sub-systems on a common turret. The method includes providing a vehicle having a turret mounted thereon, a rotatable platform of the turret supporting at least two independently stabilized pointable devices, pointing a first pointable device of the at least two independently stabilized pointable devices at an off-board target, pointing a second pointable device of the at least two independently stabilized pointable devices at the off-board target, turning the vehicle, the vehicle turning causing the first and second pointable devices to rotate with respect to the rotatable platform such that the first pointable device begins to point toward a direction of the second pointable device, and slewing the turret rotatable platform so as to decrease an extent to which the first pointable device points toward the direction of the second pointable device.

These and other embodiments of the technology are described in further detail below.

DETAILED DESCRIPTION

Figure 1:
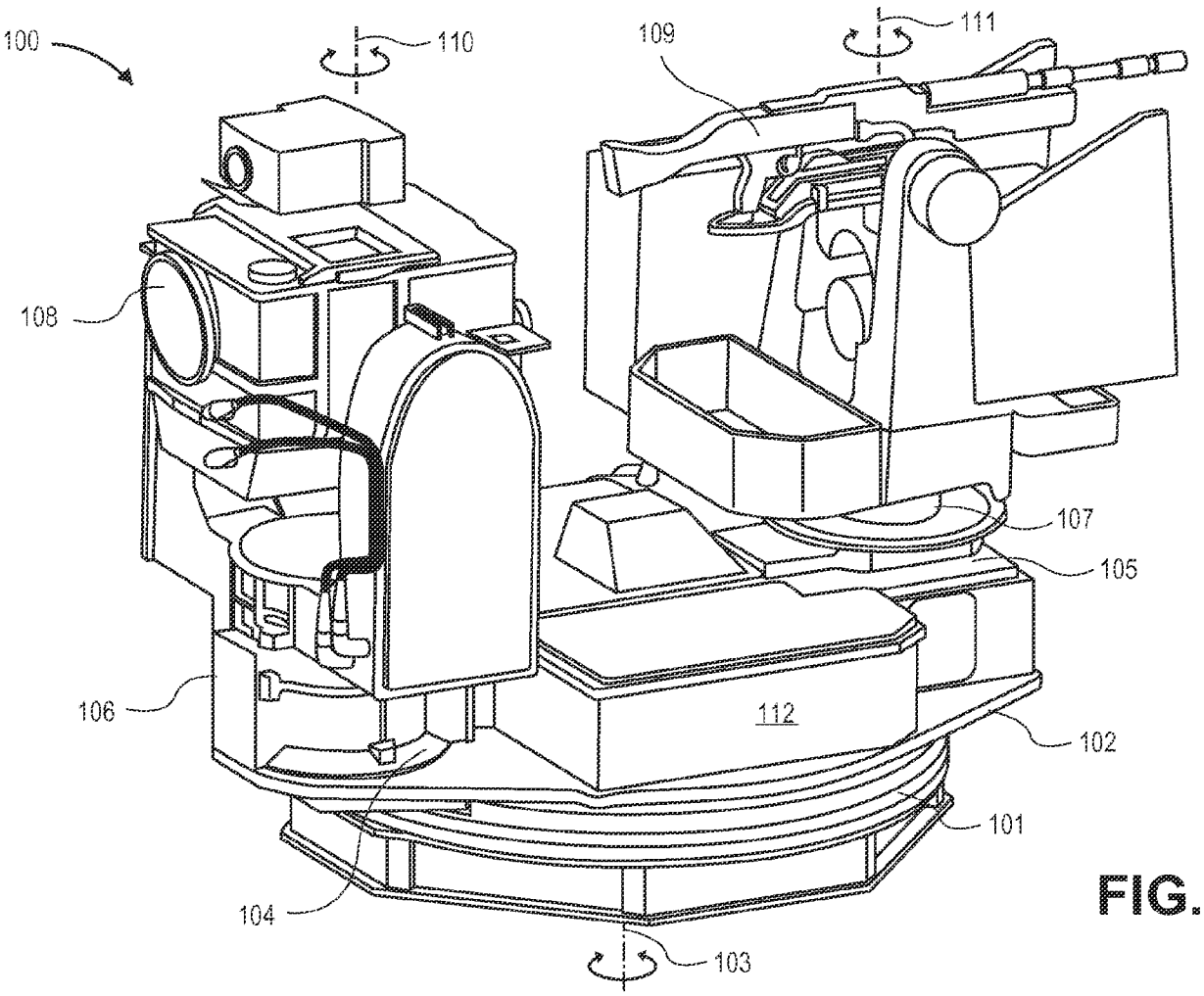
FIG. 1 depicts a turret with a gimbaled electro-optical sensor and gimbaled gun in accordance with an embodiment.

Methods for controlling a turntable with two or more fully rotatable (or gimbaled) line-of-sight devices in swivel assemblies mounted thereon is presented herein. The line-of-sight devices can include sensors, weapons, or a combination thereof. The turntable can be rotated so that one device does not occlude the line of sight of another device. For example, a sensor-gun combination can be rotated so that the sensor is not occluded by the gun and the gun does not have to shoot through the sensor.

The combination can be mode-switched so that sometimes the sensor has priority (e.g., "Sensor Priority mode") and sometimes the gun has priority (e.g., "Weapon Priority mode"). There can be non-priority modes (e.g., "Surveillance/Normal/Default mode") as well. A line-of-sight device can be aligned with respect to the axis of rotation of the turntable to minimize torque loads on the turntable, or it can be offset from another device in order to avoid damage or temporary occlusions.

Moving a device "opposite" the pointing direction of another device includes moving the first device so that it is located along the same line that the other device is pointing but in the opposite direction that the other device is pointing. One can say that this is "directly in back" of the other device.

Some embodiments have technical advantages. User selectable modes allow a selection of master and slave between different pointable devices. One device may be given priority in one situation (e.g., a sensor may have priority for covert observation missions), and the other device may be given priority in other situations (e.g., a gun may have priority during an assault). Switching between the modes can enable a quick response to changing battle situations.

Automatically slewing one of the gimbaled devices to the direction that it is pointed moves it to the front and can move another of the devices to the back, essentially automatically aligning the devices. This can reduce impulse torque loads on the underlying turret caused by weapon recoil, not only preserving motor life but lessening requirements for motor size and weight. It can increase stability and pointing accuracy when a weapon is fired. Offsetting two gimbaled devices on a rotating turret, such that they are not aligned in a direction of interest, can help a device avoid damage or temporary occlusion by effects from the other device. For example, a turret with a gun and sensor can be slewed so that the gun is in the front but 10° off to one side. This can reduce the chance that bullet casings from one side of the gun hit delicate optics on the sensor. Furthermore, reflections from the sun or other lights can be minimized by rotating the gun so that its surfaces avoid grazing angles between the sensor and sun.

Multiple independently stabilized sub-systems can be slewed about by individual human operators without having to worry about getting in each other's way. In case of possible interference, where one swivelable sub-system points at another swivelable sub-system, the underlying turret can turn to deconflict their lines of sight/bore. The sub-systems can be their own, stovepiped designs by different manufacturers, and they can be independently steered or stabilized. The turret, which can be added to a vehicle in an aftermarket fashion, takes care of deconfliction of the sub-systems.

FIG. 1 depicts a turret with a gimbaled electro-optical sensor and gimbaled gun in accordance with an embodiment. In assembly 100, turret 101 rotates platform 102. The rotation of turret 101 is controlled by control system 112.

Fire Support Sensor System (FS3) sensor 108 is mounted to a Common Remote Stabilized Sensor System (CRS3) gimbal 106, which allows for 360° rotation around axis 110. CRS3 gimbal 106 is mounted off-center from rotational axis 103 of rotatable turret 101 at position 104.

Remote Weapon System (RWS) weapon 109 is mounted off-center from rotational axis 103 at position 105. RWS weapon 109 includes its own gimbal 107 that allows it to be slewed 270° around axis 111.

FS3 sensor 108 and RWS weapon 109 are shown mounted more-or-less opposite one another on the rotatable platform of the turret. That is, they are both along a radial line passing through center of rotation 103 of the turret, but one device is on one side of the center of rotation and the other device is on the other side of the center of rotation. So that the center of gravity of the entire assembly is along turret rotation axis 103, heavier RWS weapon 109 is closer to the center than sensor 108.

Azimuth axis 111 of RWS weapon 109 is located slightly to the side of the radial line to optimally balance RWS weapon 109 between situations in which it has full and empty bullet magazines, which are side mounted.

Alternate embodiments may position devices on the same side of the rotating platform or at oblique angles with respect to a centerline. For example, devices may not be generally aligned along a centerline through the point of rotation of the turret platform. Such designs may be for weight, size, heat, or other constraints.

Between FS3 sensor 108 and RWS weapon 109 are removable covers for an inertial navigation unit (INU), a Turret Drive Assembly (TDA), and an RWS Main Processing Unit (MPU). The removable covers also house control system 112.

In some embodiments, control system 112 may be operatively unconnected from gimbal swivel assemblies 106 and 107. In other embodiments, control system 112 may receive angle data from gimbals 106 and 107 in order to determine their positions. With input of the gimbal angular positions, the control system can automatically rotate the turret in order to avoid one of the pointable devices from interfering with a line of sight or line of bore to an off-board location from the other device. For example, if gimbal 106 indicates that FS3 sensor 108 is spun to look toward the turret rotation axis 103 (and thus through RWS weapon 109), then control system 112 can rotate turret platform 102 so that RWS weapon 109 is out of the way. Gimbal swivel assembly 106, which inertially stabilizes FS3 sensor 108 so that it continues to point in the same direction in space, compensates for the turret's rotation by rotating in the opposite direction.

In other embodiments, control system 112 may send a command to gimbal 106 in order to automatically rotate gimbal 106 in the opposite direction to compensate for turret 101's rotation. Either way, the automatic compensation (by gimbal 106 itself as part of a self-stabilization process or by commands from control system 112 to gimbal 106) can assist a human operator in maintaining a clear field of view for FS3 sensor 108.

The turret can be configured to automatically slew the gun downwind of the sensor in order to prevent smoke from the gun from drifting into the view of the sensor's optics. The turret can be configured to align the gun to the right or left of the sensor to whichever side of the gun has less blast and/or muzzle flash.

The turret can automatically slew the gun's gimbal to the direction in which the gun is pointed in order to minimize recoil forces on the turret's motor. The sensor, which is in turn slewed directly behind the gun, is thus more protected by the gun's armor from incoming fire, damage of ejecting ammunition shells, and gun blast.

The control system can rotate the turret in one direction while rotating the sensor and/or weapon in an opposite direction in order to compensate for the turret's movement. The control system may directly control through voltage/current the azimuth motor of the sensor or it may simply command the sensor to rotate.

"Automatically rotating" includes rotating without direct human intervention at the time of the rotation or as otherwise known in the art.

An "off-board location" includes a location that is not on the turret, a vehicle upon which the turret is mounted, or as otherwise known in the art.

Figure 2:
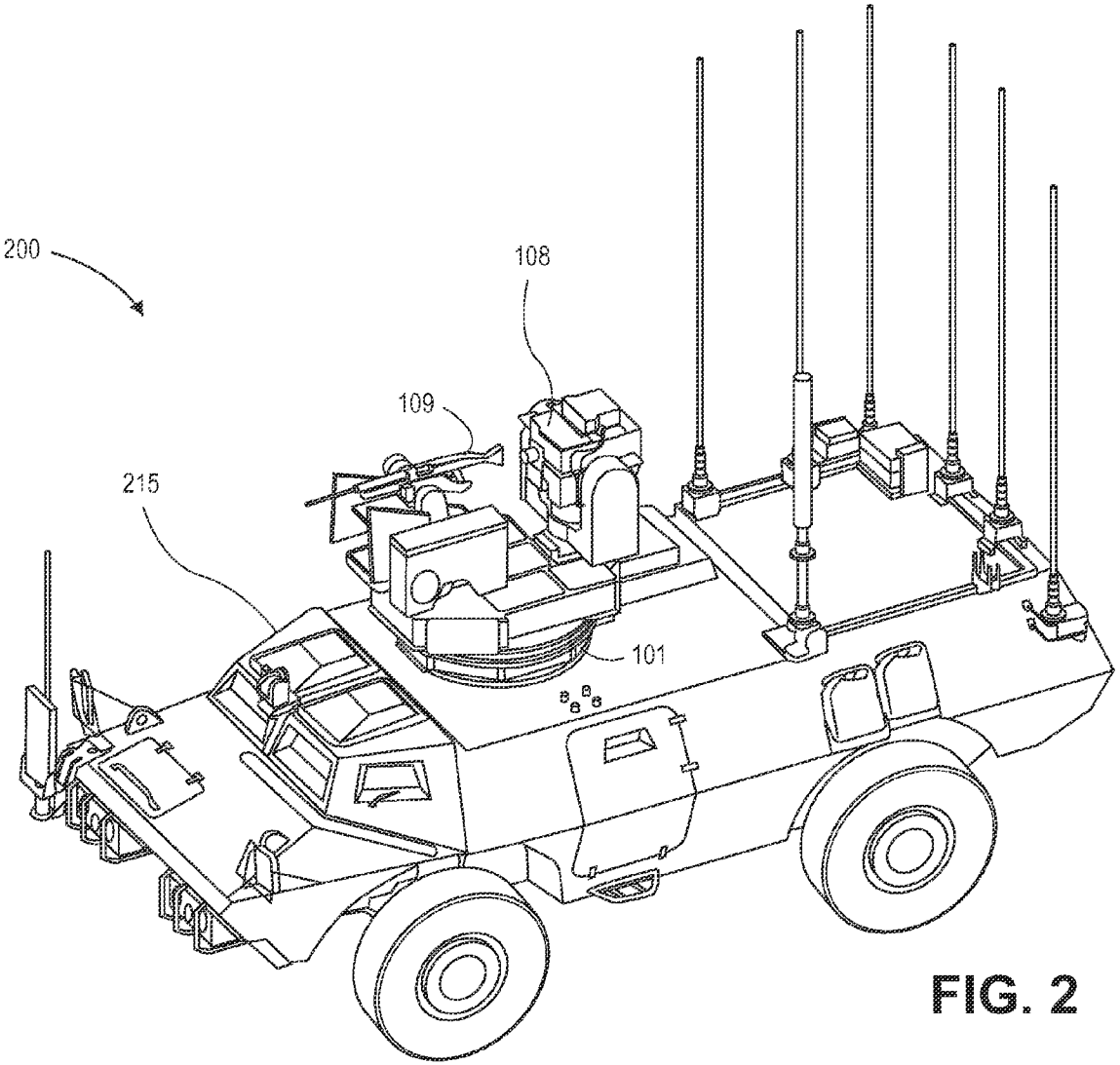
FIG. 2 depicts the apparatus of FIG. 1 mounted on an armored ground vehicle.

FIG. 2 depicts the apparatus of FIG. 1 mounted on an M1200 "Armored Knight" Armored Security Vehicle (ASV). System 200 includes turret 101, with sensor 108 and weapon 109, mounted on top of armored vehicle 215. A single human operator can control both sensor 108 and weapon 109, or multiple human operators can individually control sensor 108 or weapon 109. With the rotating turret, neither operator interferes with the field of view or line-of-bore of the other operator, such that they can work independently. This can be critical in fast-paced wartime situations in which the RWS operator must suppress a nearby enemy while the FS3 sensor operator scans for wider threats. This can also be helpful with geographically remote operators, such as those back at an encampment, that wish to survey a target with the sensor without hindering tactical operations by the local crew.

CRS3 FS3 sensor 108 on its stabilized sensor mount (SSM) and RWS gun 109 can both be aimed by crew in the protected hull of vehicle 215. In an embodiment, both the sensor and gun have independent hand controllers. The CRS3 is controlled by a hand control unit (HCU) with reference to a targeting display (TD). The RWS has its own control grip with reference to a Display Control Panel (DCP). The FS3 sensor on the CRS3 gimbal can be used to zoom in and positively identify a target to comply with current rules of engagement, while electro-optics on the RWS gun can be used for coarse and fine aiming. In some embodiments, video images from the sensor and electro-optics of the gun can be overlaid on the same display.

A tall Counter Remote Control Improvised Explosive Device (RCIED) Electronic Warfare (CREW) system Spiral II (CREW II) antenna and various whip antennas are mounted on the rear of the vehicle, aft of the turret system. Although the antennas are taller than the sensor and gun system, their narrow girth presents a small area in which one cannot see or shoot. Because they are so narrow and close to the sensor and gun system with respect to the diameter of the turret, a rotation of the turret may be able to move the gun or sensor's line of sight from intersecting with a blocking antenna.

Mastless, low-profile turret 101 adds little height to the sensor and weapon system. A minimal height is desired so that the system will fit into a C-130 transport aircraft without having to remove the sensor and gun sub-systems from the vehicle.

Figure 3:
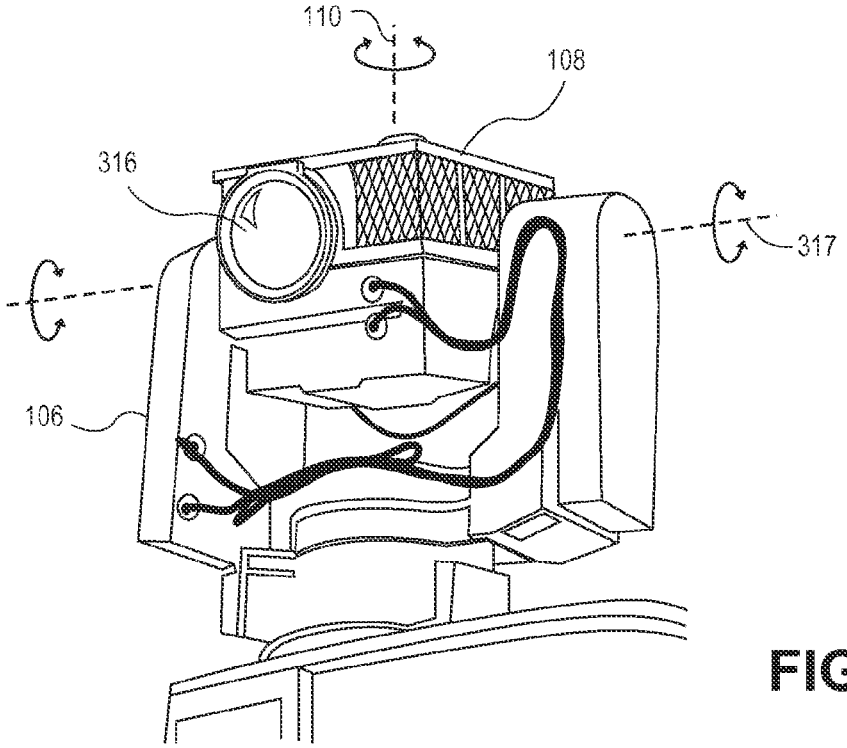
FIG. 3 illustrates a gimbaled electro-optical sensor in accordance with an embodiment.

FIG. 3 illustrates a gimbaled electro-optical FS3 sensor in accordance with an embodiment. The hardened gimbal mount provides 360° of continuous coverage as well as suitable elevation coverage. The gimbal is controlled by remote control using a yoke hand controller (HC). Video is supplied to the crew below. FS3 sensor 108 can be rotated by pan and tilt gimbal 106 in azimuth around axis 110 and in elevation around axis 317 in order to point optics 316 toward a target.

Figure 4:
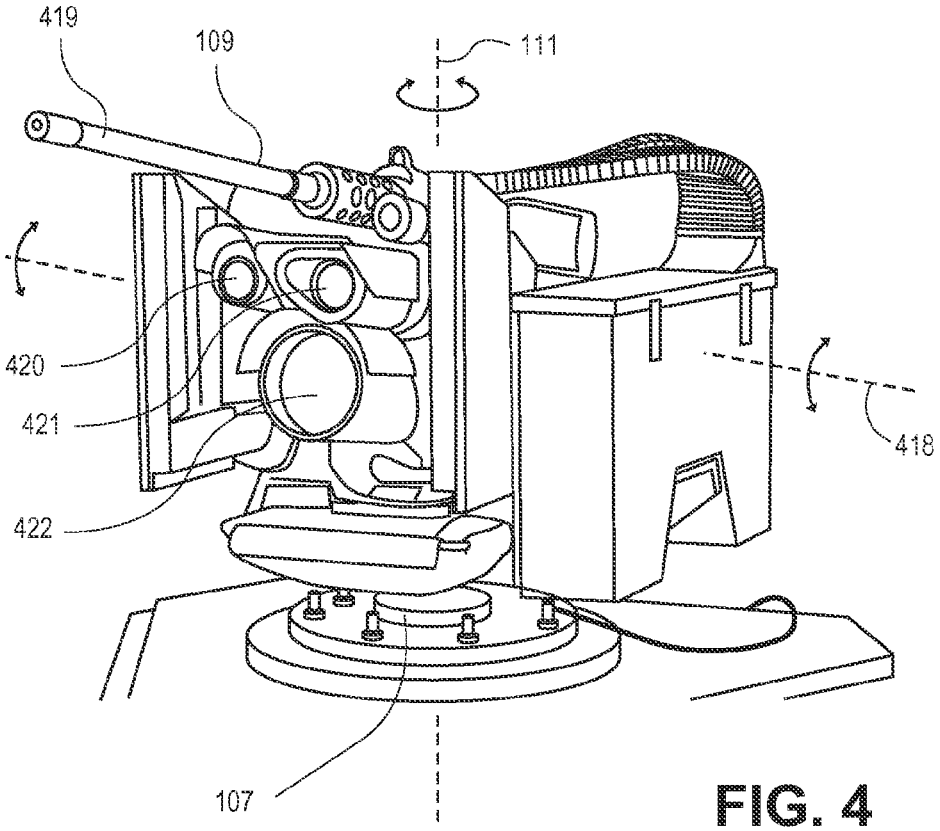
FIG. 4 illustrates a gimbaled machine gun in accordance with an embodiment.

FIG. 4 illustrates a gimbaled RWS machine gun in accordance with an embodiment. Exemplary pan and tilt weapon gimbal 107, an M151 Protector Common Remotely Operated Weapon Station (CROWS) II gimbal system, manufactured by Kongsberg Defence & Aerospace of Kongsberg, Norway, can accommodate several types of machine guns and grenade launchers.

It is gyro-stabilized and provides 360° of continuous coverage if mounted without stops. Its sensor unit includes daylight video camera 421, thermal imager 422, and laser rangefinder 420. The CROWS II weapon is one of many that can be mounted to the turret system. RWS gun 109 can be rotated in azimuth around axis 111 and in elevation around axis 418 in order to point barrel 419 toward a target.

Figure 5:
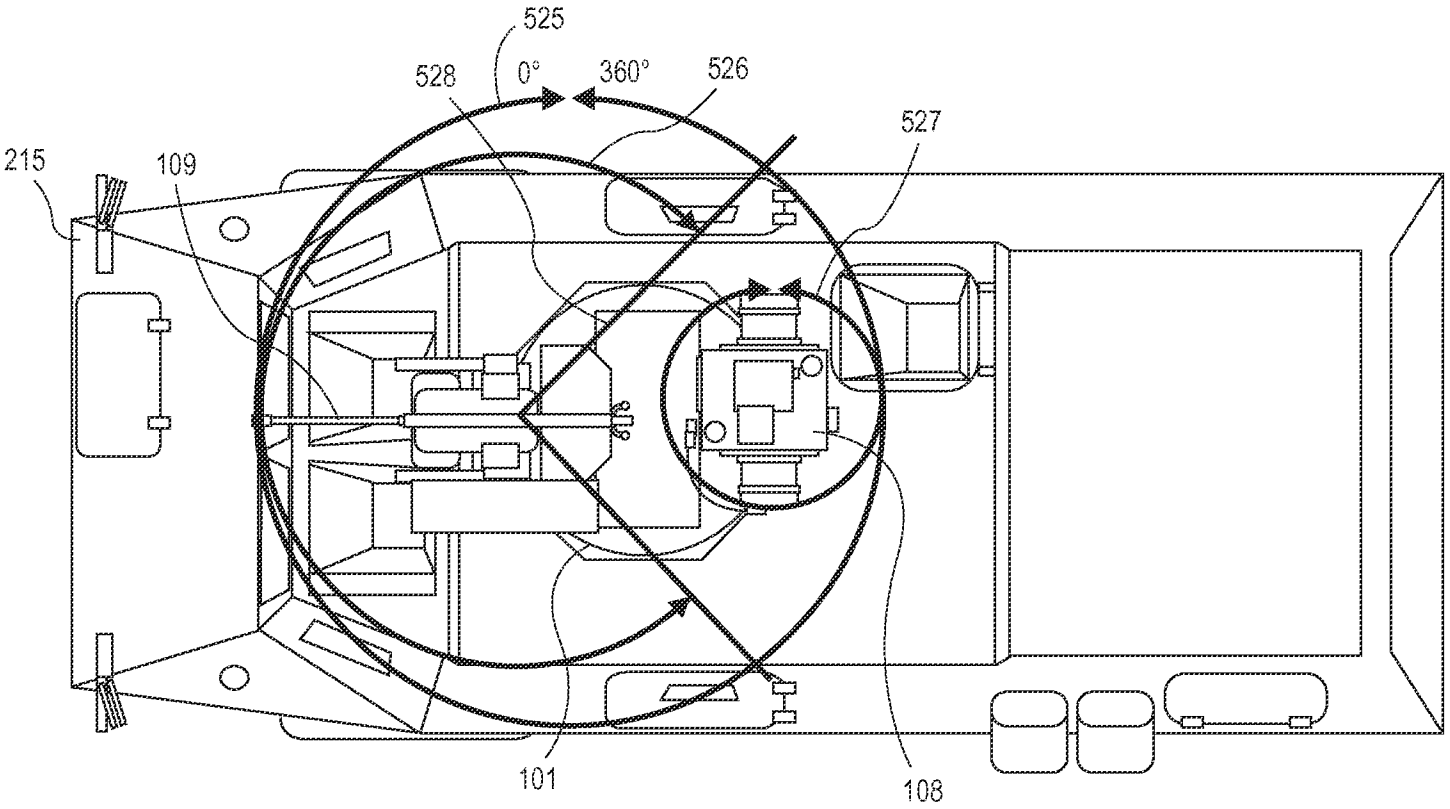
FIG. 5 is a top view of rotational degrees of freedom of an apparatus in accordance with an embodiment.

FIG. 5 is a top view of rotational degrees of freedom of an embodiment. Upon vehicle 215 is mounted turret apparatus 101. Upon turret apparatus 101 is mounted gimbaled sensor 108 and weapon 109. Sensor 108 can be freely rotated 360° as indicated by full circle 527. Weapon 109, with its long barrel, has hard stops at ±45° with respect to sensor 108 (at 0°, or horizontally right in the diagram), as indicated by ¾circle 526. RWS weapon 109 has approximately 270° of motion envelope from stop to stop. Thus, the long gun barrel cannot contact the sensor gimbal. There are 'soft' stops, using software, that prevent the gun from being rammed or driven into the hard stops at full force.

If an operator wishes to point weapon 109 between ±45° of the right in the diagram (i.e., over the back of vehicle 215), then turret 101 can be rotated 45°, 90°, 180°, or any other angle as appropriate as indicated by 360° full circle 525 so that weapon 109 is no longer hindered by the hard or soft stops. For example, if turret 101 is rotated 90°, then weapon 109 and sensor 108 are perpendicular to the rear, and both have lines of sight (or bore) to the rear of the vehicle. Other configurations from the exemplary embodiment are envisaged.

Figure 6:
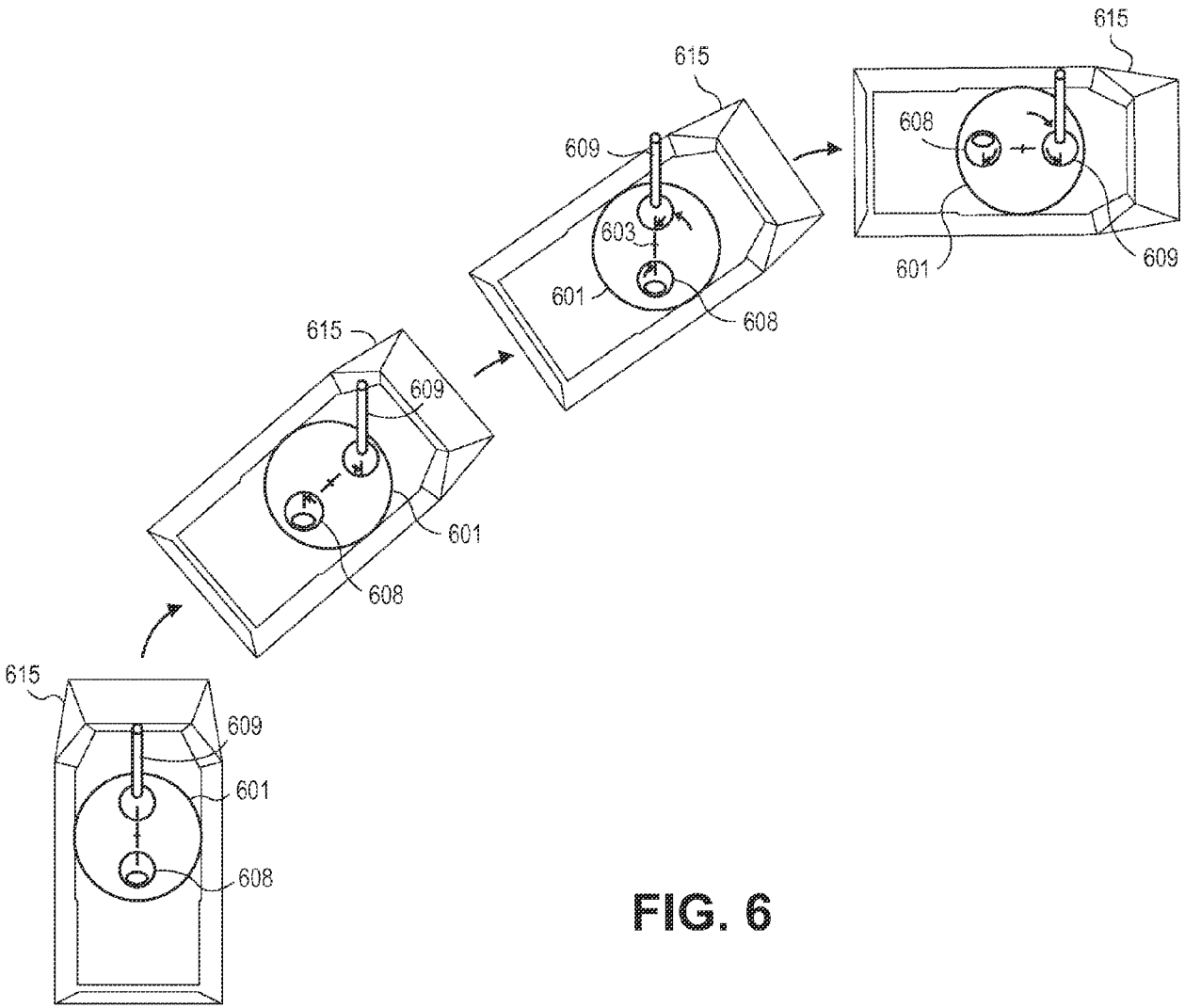
FIG. 6 illustrates a gun-in-front mode on a moving vehicle in accordance with an embodiment.

FIG. 6 illustrates a gun-in-front mode on a moving vehicle in accordance with an embodiment. The vehicle moves from the lower left to the upper right in the figure.

In the bottom left of the figure, armored vehicle 615 starts out with weapon 609 pointed at an off-board target to the north, beyond the top of the page. Turret 601 is rotated such that sensor 608 is behind weapon 609, looking south, toward the bottom of the page.

Armored vehicle 615 proceeds upward and turns slightly east (right), as shown at the next position of vehicle 615. Inertially stabilized sensor 608 and weapon 609 rotate with respect to turret 601 in order to continue pointing north and south, respectively, compensating for the vehicle's turn. Turret 601 has not yet slewed with respect to vehicle 615.

Armored vehicle 615 proceeds northeast and turns a little more to the east (right), as shown in the next position of vehicle 615. Inertially stabilized weapon 609 rotates a little more with respect to turret 601 in order to maintain its lock on the northern off-board target. This rotation of weapon 609 triggers turret 601 to rotate so as to minimize the angle between the direction weapon 609 points and turret rotation axis 603. The weapon is slewed nearest the off-board target. To stay pointed at the target, weapon 609 rotates with respect to turret 601, and sensor 608 rotates with respect to turret 601 in order to stay pointed south. If weapon 609 were to shoot, this orientation of having turret rotation axis directly behind weapon 609 would minimize recoil forces on the bearings and motor for turret 601.

Note that turret 601 has slewed counterclockwise while inertially stabilized sensor 608 and weapon 609 have rotated clockwise in order to compensate for the rotation of the turret.

Armored vehicle 615 then turns due east (right) as shown in the last position of vehicle 615 (in the upper right of the figure). An operator switches modes so that sensor 608 slaves to track the same off-board, northern target as weapon 609. Sensor 608 rotates so that it faces north, and turret 601 revolves so that sensor 608 comes out from behind weapon 609. In this configuration, a line between sensor 608 and weapon 609 is 90° perpendicular to a line between the off-board target and the turret. This enables both sensor 608 and weapon 609 to view the off-board target without obstruction from one another.

Figure 7:
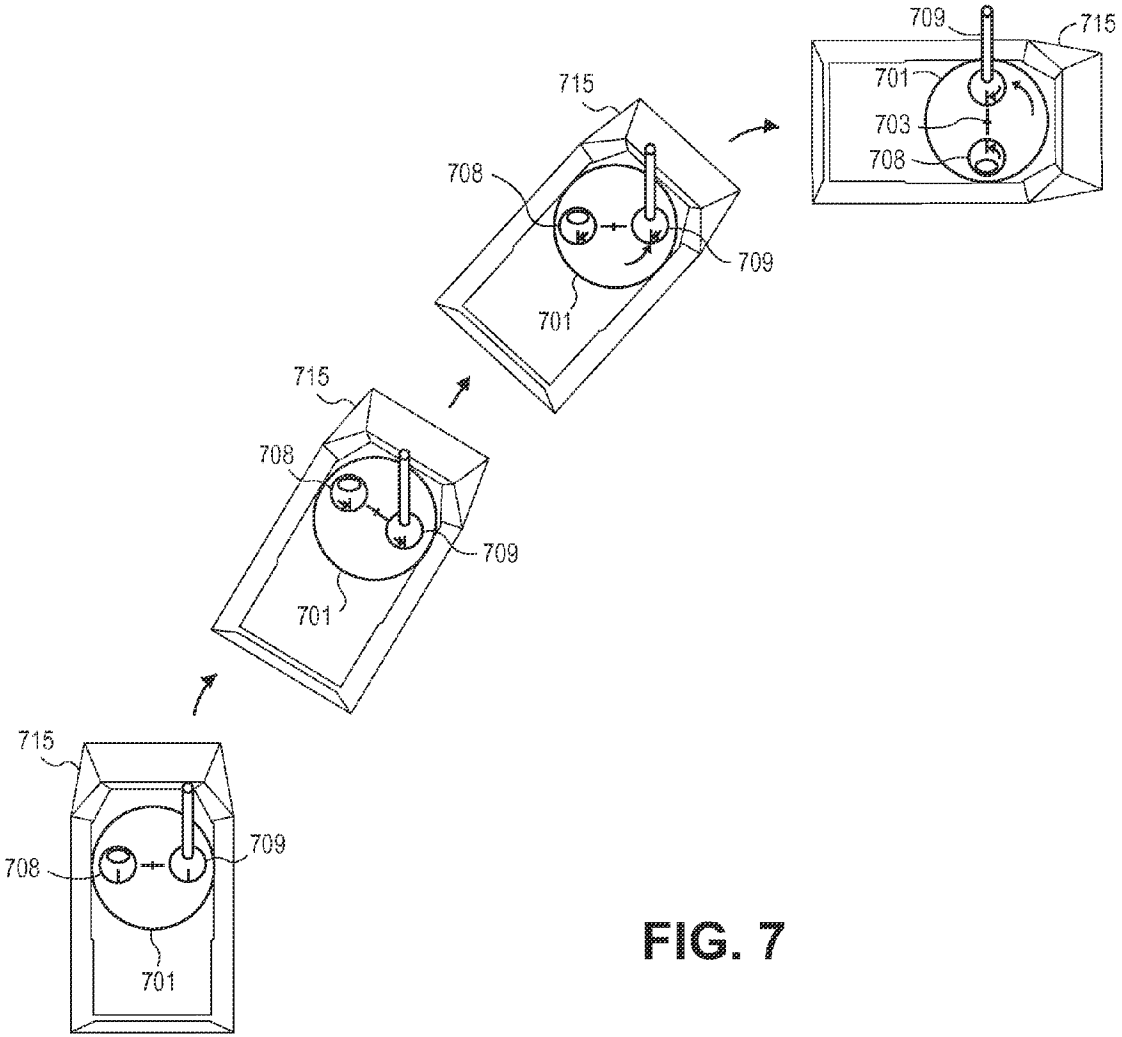
FIG. 7 illustrates a side-by-side mode on a moving vehicle in accordance with an embodiment.

FIG. 7 illustrates a side-by-side mode on a moving vehicle in accordance with an embodiment. The vehicle moves from the lower left to the upper right in the figure.

In the bottom left of the figure, armored vehicle 715 starts out with sensor 708 and weapon 709 pointed at an off-board target to the north, beyond the top of the page. Turret 701 is configured such that sensor 708 and weapon 709 are 90° perpendicular to one another and the off-board target.

Armored vehicle 715 proceeds upward and turns slightly east (right), as shown at the next position of vehicle 715. Inertially stabilized sensor 708 and weapon 709 rotate with respect to turret 701 in order to continue pointing north. Turret 701 has not yet slewed with respect to vehicle 715.

Armored vehicle 715 proceeds northeast and turns a little more to the east (right), as shown in the next position of vehicle 715. Inertially stabilized sensor 708 rotates a little more with respect to turret 701 in order to continue looking north. This rotation of sensor 708 triggers turret 701 to rotate so as to continue the 90° perpendicular configuration between the sensor-weapon line and due north. Sensor 708 and weapon 709 rotate with respect to turret 701 in order to stay pointed north. This 90° perpendicular configuration allows both sensor 708 and weapon 709 to have a wide field of regard in scanning to the north and not interfere with one another.

Turret 701 has slewed counterclockwise while inertially stabilized sensor 708 and weapon 709 have rotated clockwise in order to compensate for the rotation of the turret.

Armored vehicle 715 the turns due east (right) as shown in the last position of vehicle 715 in the figure (in the upper right of the figure). An operator switches weapon 709's mode to ARM, which automatically switches turret 701 mode to GUN. This results in turret 701 revolving so that weapon 709 is in front, and turret axis of rotation 703 is aligned directly behind where weapon 709 is pointed. Meanwhile, sensor 708 turns so that it faces away from weapon 709 so as to protect its optics from ejected shell casings, smoke, and blast.

Turret 701 can be configured to automatically slew weapon 709 downwind of sensor 708 in order to prevent smoke from the weapon from drifting into the view of the sensor's optics. The turret can be configured to align the gun to the right or left of the sensor to whichever side of the gun has less blast and/or muzzle flash.

As shown, a turret control system can rotate the turret in one direction while rotating the sensor and/or weapon in an opposite direction in order to compensate for the turret's movement. At an infinite distance to a target, the rotations are exactly opposite. At very close distances, there are situations in which a sensor and/or weapon in the back will rotate in the same direction as the turret in order to remain pointed at a target off-board the vehicle. Between these two extremes, the sensor and weapon generally rotate in an opposite direction from the rotation of the turret in order to remain pointed at the off-board target or stabilized with respect to terrain.

Figure 8:
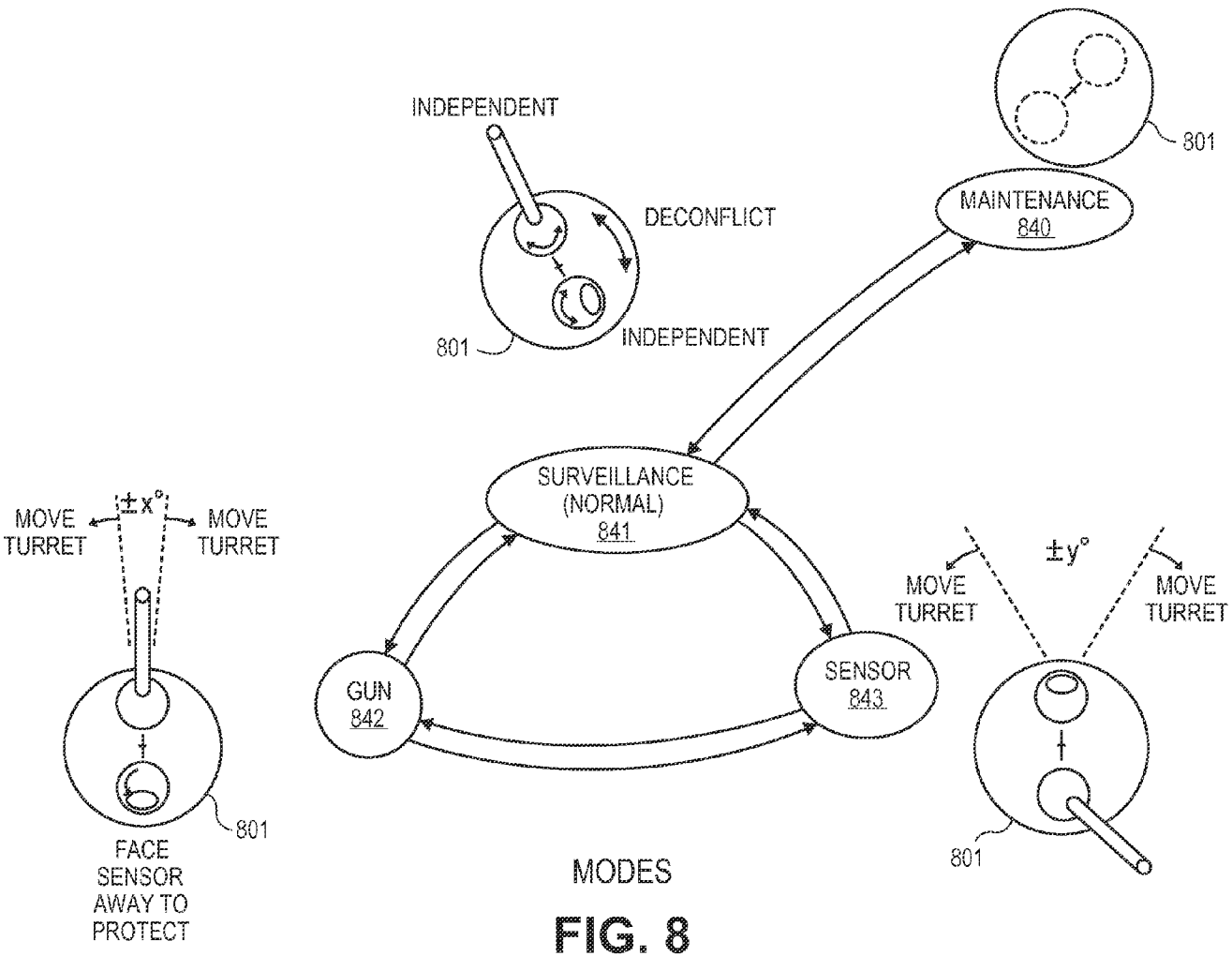
FIG. 8 is a state diagram in accordance with an embodiment.

FIG. 8 is a four-state diagram for a turret in accordance with an embodiment.

In maintenance mode 840, turret 801 can be rotated manually by a human operator. This mode may be used for positioning the turret so that a sub-system can be lifted by a crane, stowing the turret in a pin position for transport, spreading lubricating grease along its gear rings, or other reasons.

In surveillance mode 841, two or more sub-systems, such as a gyro-stabilized gun and sensor, can be operated independently. Only if one sub-system attempts to point through the other will the turret move automatically in order to prevent the conflict. For example, if a gun rotates so that it points more towards a sensor, then the turret can slew so that the gun points perpendicularly or away from the sensor.

In gun mode 842, a turret can closely follow the rotation of a pointable weapon so as to keep the weapon in front. For example, if a gun in a swivel assembly is rotated by greater than a threshold of ±0.5°, ±1°, ±2°, ±3°, ±4°, ±5°, ±10°, or ±15°, then the turret can be rotated so that the relative rotation angle of the weapon to the turret falls below the angle threshold. The threshold may be user-selected. Smaller threshold angles will minimize recoil moment forces on a turret motor and bearings. In this mode, rotation of one or more other pointable devices has no effect on turret rotation.

In sensor mode 843, a turret can loosely follow the rotation of a pointable sensor so as to keep the sensor in front while minimizing energy used to move the turret. For example, if a gimbaled sensor is rotated by greater than a threshold of ±10°, ±15°, ±20°, ±25°, ±30°, ±35°40°, ±45°, ±50°, ±55°, ±60°, ±65°, ±70°, ±75°, ±80°, ±85°, or ±90° then the turret can be rotated so that the relative rotation angle of the sensor to the turret falls below the angle. The threshold may be user-selected. A large threshold can minimize power used for moving the turret while keeping the sensor and other sub-systems on the turret deconflicted.

A "slew-to-cue mode" (not shown in the figure) can result in one line-of-sight device pointing to follow an off-board position at which another line-of-sight device points. The first device is a slave, and the second device is a master. If the master drops the track, then the slave can be relieved of its duty of following the master. If the master device is then aimed at another target, then the slave device can be rotated so that it faces the new target. The turret can keep the devices automatically deconflicted so that they do not point through one another, even when they both look at the same target.

A "stow mode" can face a sensor to the aft of the vehicle to offer some lens protection when on the move. A "protection mode" can keep hardened portions of the devices pointed in the direction that a gun or rocket launcher is facing and more vulnerable portions (e.g., the lenses of the sensor) away.

In some embodiments, a user can be allowed to select a configuration to automatically avoid. For example, if a soldier determines that spent bullet casings fly out of a gun on its right side, then the solder can select a 'left side' bias so that the sensor is slewed to the left side of where the gun points. This can be at 90° so that the gun and sensor are equidistant from an off-board target or at 5°, 10°, 15°, or other angles in back. For example, biasing the sensor so that it stays 10° to the left side of directly behind the weapon may be all that is needed to avoid flying bullet casings but otherwise minimize torque loads on the turret. In another example, wind direction can be used to position the sensor upwind of the gun to avoid smoke. Wind direction can be measured off-board or on board a vehicle. For example, wind direction (and wind speed) can be measured on the turret.

In other embodiments, automatic slewing can be used for off-board control. A soldier can be positioned outside the vehicle and have the turret automatically align itself. For on-the-go operations, an operator can concentrate on movement and tactics while mobile without having to manually adjust the turret as a weapon or sensor is rotated about.

One operator may control the sensor while another operator controls the weapon. The operator controlling the sensor may take a second seat to the operator controlling the weapon. As the weapon is slewed about, the turret is moved so that the weapon does not occlude the sensor's line of sight, allowing seamless sharing of subsystems on the same vehicle without blind spots to either operator.

One operator of one subsystem can be off-board the vehicle and another operator on board the vehicle. For example, a remote special operations force may wish for images from the sensor and remotely address the sensor so that it slews to observe a position of interest. Meanwhile, an operator safely within the vehicle controls the gun. As the local operator within the vehicle slews the gun around, the turret and dual gimbals turn to keep the sensor trained on what the remote operator is viewing. With automatic slewing and compensation by the turret/gimbal system, the two operators are less likely to interfere with each other.

Figure 9:
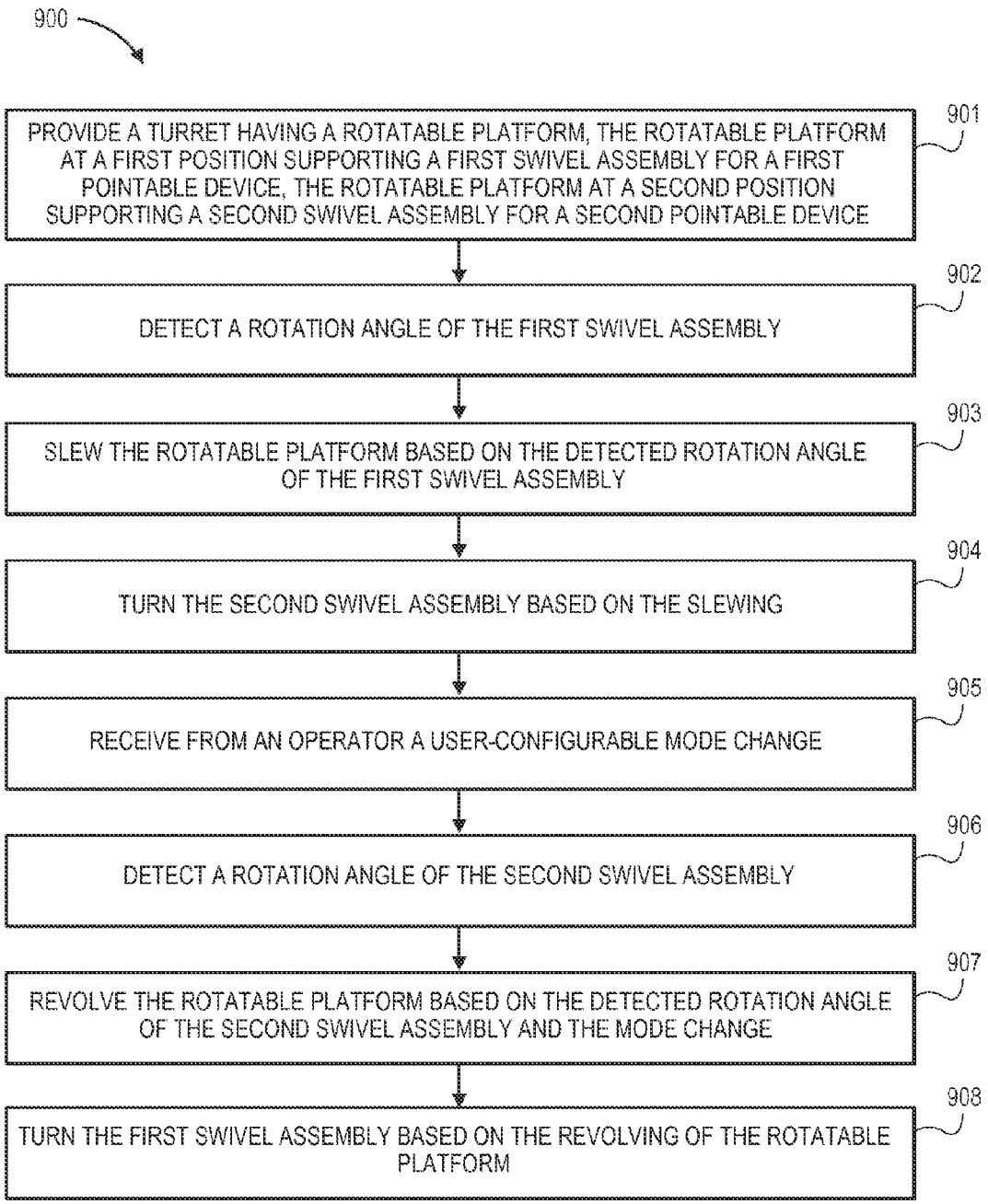
FIG. 9 is a flowchart illustrating a process in accordance with an embodiment.

FIG. 9 is a flowchart illustrating a process in accordance with an embodiment. Process 900 can be performed at a factory, by an end user, or by others as appropriate. In operation 901, a turret having a rotatable platform is provided. The rotatable platform supports at a first position a first swivel assembly for a first pointable device, and it supports at a second position a second swivel assembly for a second pointable device. In operation 902, a rotation angle or rate of the first swivel assembly is detected. In operation 903, the rotatable platform is slewed based on the detected rotation angle or rate of the first swivel assembly. In operation 904, the second swivel assembly is turned based on the slewing of the rotatable platform.

In operation 905, a user-confgurable mode change is received from an operator. In operation 906, a rotation angle of the second swivel assembly is detected. In operation 907, the rotatable platform is revolved based on the detected rotation angle of the second swivel assembly and the mode change. In operation 908, the first swivel assembly is turned based on the revolving of the rotatable platform.

Figure 10:
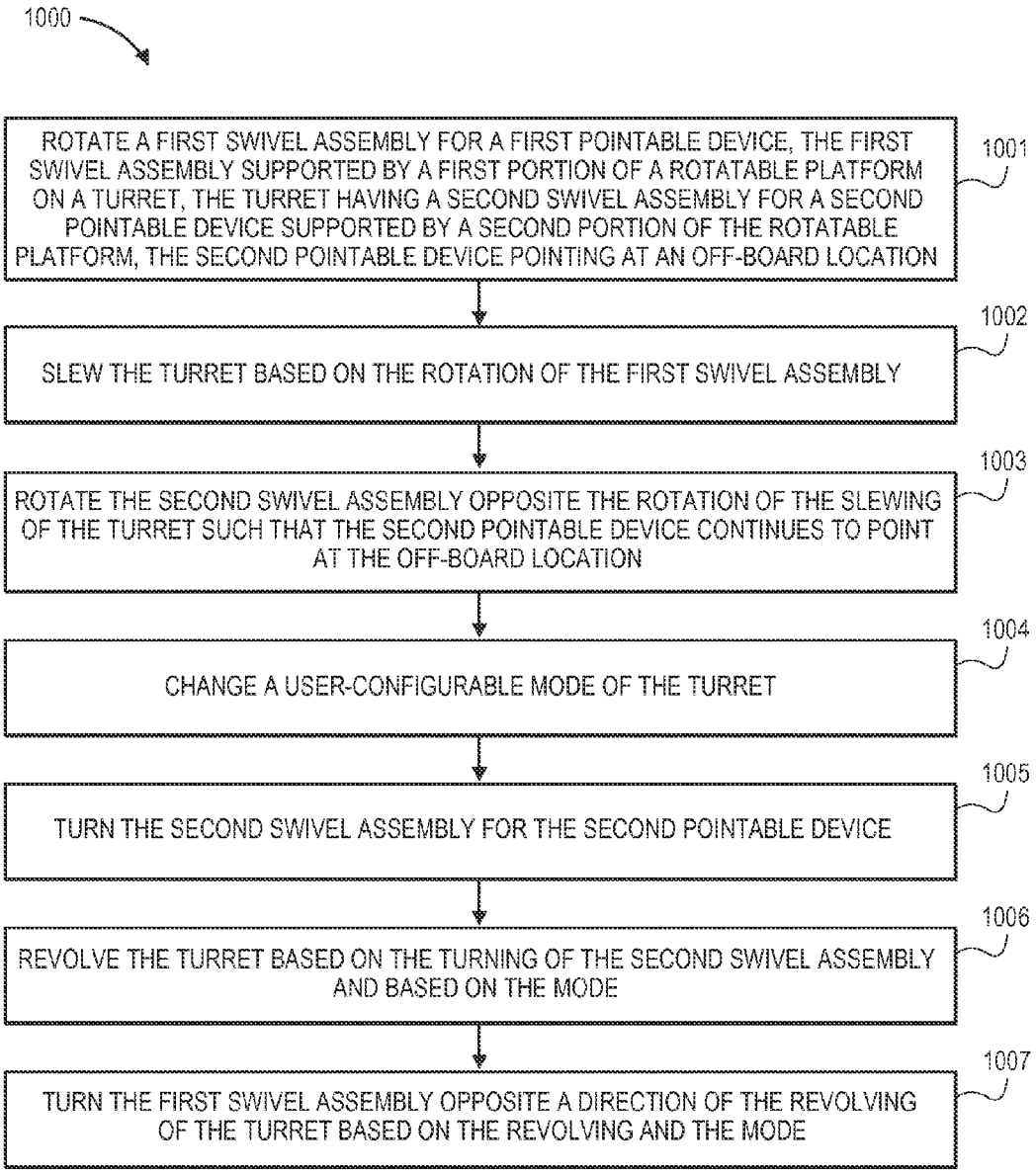
FIG. 10 is a flowchart illustrating a process in accordance with an embodiment.

FIG. 10 is a flowchart illustrating a process in accordance with an embodiment. Process 1000 can be performed at a factory, by an end user, or by others as appropriate. In operation 1001, a first swivel assembly for a first pointable device is rotated, the first swivel assembly supported by a first portion of a rotatable platform on a turret, the turret having a second swivel assembly for a second pointable device supported by a second portion of the rotatable platform, the second pointable device pointing at an off-board location. In operation 1002, the turret is slewed based on the rotation of the first swivel assembly. In operation 1003, the second swivel assembly is rotated opposite the rotation of the slewing of the turret such that the second pointable device continues to point at the off-board location.

In operation 1004, a user-configurable mode of the turret is changed. In operation 1005, the second swivel assembly for the second pointable device is turned. In operation 1006, the turret is revolved based on the turning of the second swivel assembly and based on the mode. In operation 1007, the first swivel assembly is turned opposite a direction of the revolving of the turret based on the revolving and the mode.

Figure 11:
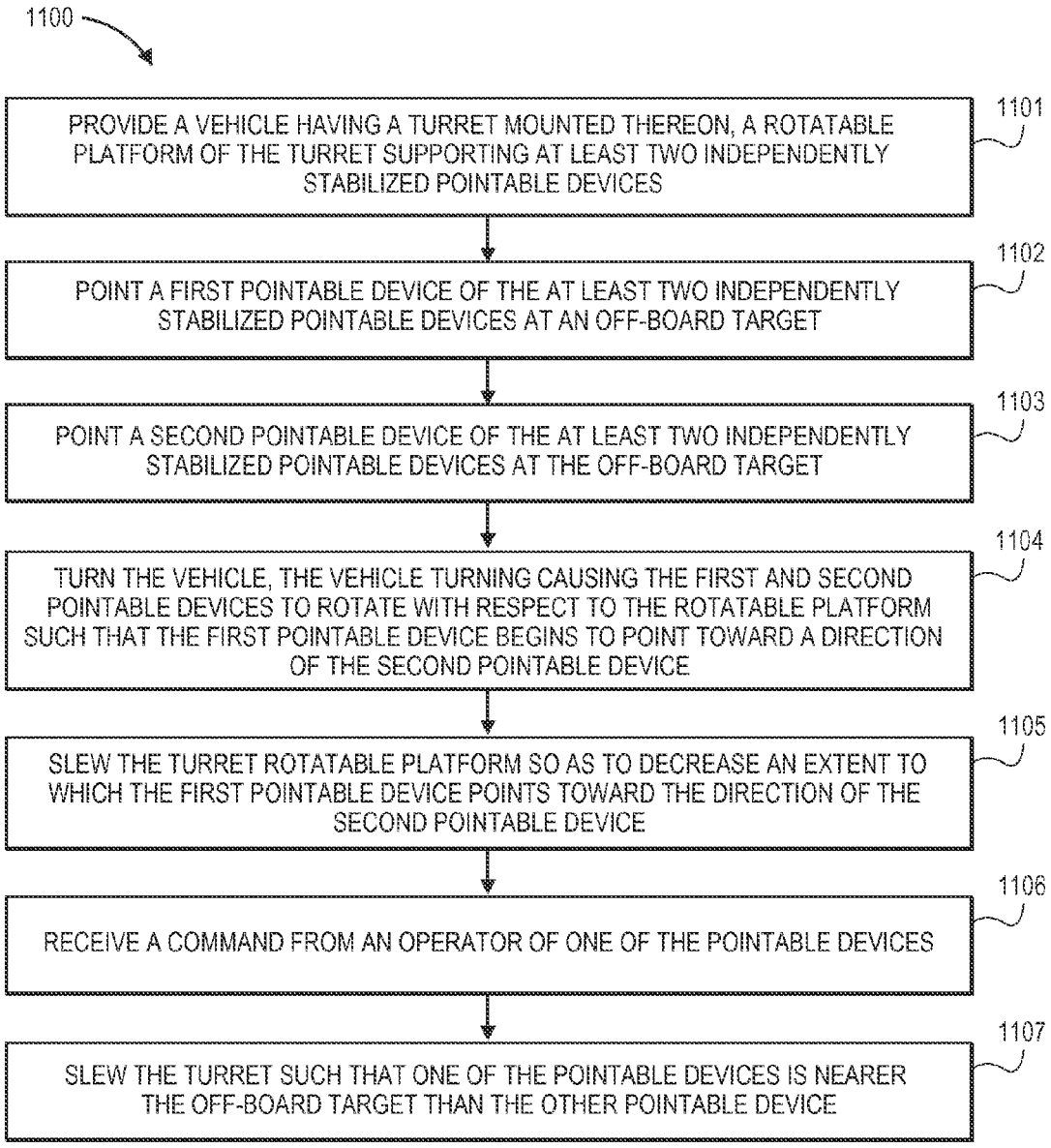
FIG. 11 is a flowchart illustrating a process in accordance with an embodiment.

FIG. 11 is a flowchart illustrating a process in accordance with an embodiment. Process 1100 can be performed at a factory, by an end user, or by others as appropriate. In operation 1101, a vehicle having a turrret mounted thereon is provided, a rotatable platform of the turret supporting at least two independently stabilized pointable devices. In operation 1102, a first pointable device of the at least two independently stabilized pointable devices is pointed at an off-board target. In operation 1103, a second pointable device of the at least two independently stabilized pointable devices is pointed at the same off-board target. In operation 1104, the vehicle is turned, the vehicle turning causing the first and second pointable devices to rotate with respect to the rotatable platform such that the first pointable device begins to point toward a direction of the second pointable device. In operation 1105, the rotatable platform of the turret is slewed so as to decrease an extent to which the first pointable device points toward the direction of the second pointable device. In operation 1106, a command from an operator of one of the pointable devices is received. In operation 1107, the turret is slewed such that one of the pointable devices is nearer the off-board target than the other pointable device.

It should be understood that the present technology as described above can be implemented in the form of control logic using computer software in a modular or integrated manner. Based on the disclosure and teachings provided herein, a person of ordinary skill in the art will know and appreciate other ways and/or methods to implement the present technology using hardware and a combination of hardware and software.

Any of the software components or functions described in this application, may be implemented as software code to be executed by a processor using any suitable computer language such as, for example, Java, C++ or Perl using, for example, conventional or object-oriented techniques. The software code may be stored as a series of instructions, or commands on a computer readable medium, such as a random access memory (RAM), a read only memory (ROM), a magnetic medium such as a hard-drive or a floppy disk, or an optical medium such as a CD-ROM. Any such computer readable medium may reside on or within a single computational apparatus, and may be present on or within different computational apparatuses within a system or network.

The above description is illustrative and is not restrictive. Many variations of the technology will become apparent to those skilled in the art upon review of the disclosure. The scope of the technology should, therefore, be determined not with reference to the above description, but instead should be determined with reference to the pending claims along with their full scope or equivalents.

One or more features from any embodiment may be combined with one or more features of any other embodiment without departing from the scope of the technology.

A recitation of "a", "an" or "the" is intended to mean "one or more" unless specifically indicated to the contrary.

What is claimed is:

1. A computer-readable non-transitory medium embodying information indicative of instructions for causing one or more machines to perform operations for controlling a turret with swivel assemblies mounted thereon, the operations comprising:

retrieving information associated with a turret having a rotatable platform, the rotatable platform at a first position supporting a first swivel assembly for a first pointable device, the rotatable platform at a second position supporting a second swivel assembly for a second pointable device;

detecting a rotation angle of the first swivel assembly;

slewing the rotatable platform based on the detected rotation angle of the first swivel assembly; and turning the second swivel assembly based on the slewing.

2. The medium of claim 1 wherein the operations further comprise:

receiving from an operator a user-configurable mode change;

detecting a rotation angle of the second swivel assembly;

revolving the rotatable platform based on the detected rotation angle of the second swivel assembly and the mode change; and turning the first swivel assembly based on the revolving of the rotatable platform.

3. The medium of claim 2 wherein the user-configurable mode change is configured to switch a master-slave relationship of the first and second pointable devices.

4. The medium of claim 1 wherein the operation for slewing of the rotatable platform is based upon an angle of a soft or hard stop, which protects the first pointable device from pointing at the second device.

5. The medium of claim 4 wherein the first pointable device includes a weapon.

6. The medium of claim 5 wherein the weapon is selected from the group consisting of a gun, directional missile or rocket launcher, grenade launcher, microwave weapon, ultrasonic weapon, electromagnetic impulse weapon, and weaponized laser.

7. The medium of claim 1 wherein the operation for slewing of the rotatable platform is based upon a predictable, transient occlusion or danger to the second device from a side or back of the first pointable device.

8. The medium of claim 7 wherein the first pointable device includes a gun or directional missile or rocket launcher, and the predictable, transient occlusion or danger is selected from the group consisting of ejected shell casings, smoke, and blast.

9. The medium of claim 7 wherein the operation for slewing of the rotatable platform is based upon a wind direction with respect to a direction between the first and second pointable devices.

10. The medium of claim 1 wherein the second pointable device includes a sensor.

11. The medium of claim 10 wherein the sensor is selected from the group consisting of a millimeter wave scanner, ultraviolet sensor, optical sensor, infrared sensor, radar, lidar, and laser rangefinder.

12. The medium of claim 1 wherein the rotatable platform is configured to be slewed such that the second device is opposite the pointing direction of the first pointable device, thereby slewing the second device behind the first pointable device.

13. The medium of claim 1 wherein the rotatable platform is configured to be slewed such that the second device is offset from opposite the pointing direction of the first pointable device.

14. The medium of claim 1 wherein the second swivel assembly is configured to be rotated such that the second pointable device points away from the first device for stowage.

15. The medium of claim 1 wherein the turret is connected with a vehicle selected from the group consisting of a wheeled armored vehicle, tracked vehicle, surface ship, helicopter, lighter-than-air aircraft, and airplane.

* * * * *